United States Patent [19]

Mulvaney

[11] Patent Number: 4,689,832

[45] Date of Patent: Sep. 1, 1987

[54] PARTIALLY DETACKIFIED LEATHER AND GLOVE

[75] Inventor: Lewis W. Mulvaney, Ho-Ho-Kus, N.J.

[73] Assignee: R. Neumann & Co., Hoboken, N.J.

[21] Appl. No.: 832,751

[22] Filed: Feb. 25, 1986

Related U.S. Application Data

[62] Division of Ser. No. 671,761, Nov. 14, 1984, Pat. No. 4,598,429.

[51] Int. Cl.[4] ..... B05D 1/18; B05D 1/36; B05D 3/02; A41D 19/02

[52] U.S. Cl. ..... 2/161 A; 2/169; 427/379; 427/387; 427/389; 427/412; 427/430.1

[58] Field of Search ..... 427/389, 387, 412, 379, 427/430.1; 2/161 A, 168, 169

[56] References Cited

U.S. PATENT DOCUMENTS

| | | | |
|---|---|---|---|
| 3,816,168 | 6/1974 | Lewis et al. | 427/389 |
| 4,000,958 | 1/1977 | Hirooka et al. | 427/389 |
| 4,190,687 | 2/1980 | Sugiura et al. | 427/389 |
| 4,272,568 | 6/1981 | Berend | 427/412 X |

*Primary Examiner*—Michael R. Lusignan

*Attorney, Agent, or Firm*—Wenderoth, Lind & Ponack

[57] ABSTRACT

A permanently tackified leather glove having its inner surface detackified with a solution containing nitrocellulose and silicone resins and process for making same as well as the leather therefor.

6 Claims, No Drawings

PARTIALLY DETACKIFIED LEATHER AND GLOVE

This is a Rule 60 Divisional of Ser. No. 671,761, filed Nov. 14, 1984, now U.S. Pat. No. 4,598,429, patented July 8, 1986.

FIELD OF THE INVENTION

This invention relates to a method for the production of leather permanently tackified on one side and detackified on the other (non-tackified back, herein designated NTB) and a sport or work glove made from said leather.

Such glove is more comfortable to wear than a glove tackified on both sides.

BACKGROUND AND PRIOR ART

It is generally known to provide tackified gloves for applications where improved gripping security is important, e.g. golf, racquetball, tennis, squash, soccer, football, baseball, etc.

In order to accomplish this, various coatings such as polyurethanes and latices have been employed. Moreover, in German Offenlegungsschrift No. 28 40 197, it was suggested to coat a sticky material onto the surface of the glove, preferably, by the use of an adhesive spray.

However, none of these known approaches are entirely satisfactory. Urethanes and latices lack the requisite tack or coefficient of friction and do not possess the "feel" of leather. Moreover, adhesive coatings of the spray-on type tend to lack permanence and also deteriorate the leather.

Still further, in Applicant's copending application, Ser. No. 443,655, filed Nov. 22, 1982, now abandoned, various hydrocarbon resin-impregnated tackified coatings are described.

In the Applicant's previous approach to tackifying leather, both sides of the leather were tackified. In a glove, this is disadvantageous because of the discomfort in having a tacky inner surface in contact with the hand of the wearer.

While the above-described German reference does not have this problem because the tackified coating is sprayed on the surface of the leather, it also does not have the desired permanence that is imparted to the glove when it is tackified by impregnation in a solution of a tackifying resin.

OBJECTIVES AND BRIEF SUMMARY OF THE INVENTION

Accordingly, it is an object of the present invention to provide a glove which is permanently tackified by impregnation in order to obtain the desired permanence of the coating but which, has a non-tacky inner surface with the "feel" of leather.

It is a further objective of this invention to provide a process for producing such glove.

It is a still further objective of the present invention to provide a leather permanently tackified by impregnation, with the outer or grain side tackified and the inner or flesh side is detackified.

These and other objectives realized by the present invention wherein both sides of the leather are impregnated with a solution containing an isobutylene-butene copolymer produced by polymerization of normal and branched chain butenes and a hydrocarbon tackifying resin, to impart the desired degree of tack to the leather.

Then the inner or flesh side of the leather is coated with a solution containing, a silicone resin and a nitrocellulose binder to provide a detackified surface having the desired degree of adhesion to and compatability with the already tackified leather.

The nitrocellulose, by itself, will provide a barrier between the user's hand and the tackified surface, however, the feel of the dried nitrocellulose is rather hard and not leather-like. On the other hand, the silicone resin without the nitrocellulose will not provide the desired degree of adhesion to the substrate. By combining these two materials, it is possible to obtain the desired non-tacky inner surface having suitable adhesion, yet retaining the "feel" of the leather.

If an excess of silicone is employed, a glove will feel uncomfortably slippery and if too little is used, the hard un-leather-like feel of the nitrocellulose will be apparent.

By emloying the correct amount of silicone in combination with the nitrocellulose it becomes possible to obtain a comfortable, dry yet non-tacky sensation.

DETAILED DESCRIPTION

The process of this invention is applicable to a wide variety of leathers such as calfskin, cowhide, cabretta and pigskin. The leather must be in the crust condition before treatment, that is, it must be unfilled and unfinished and should preferably be chrome tanned.

With respect to the tackifying composition, any of a wide variety of hydrocarbon-type tackifying resins may be employed. For example, there may be mentioned aromatic hydrocarbon resins and aliphatic hydrocarbon resins.

A particularly preferred tackifying resin is a polymerized hydrocarbon resin of the Piccopale type, such as Piccolyte S 70, available from Pennsylvania Industrial Chemicals Corporation, Clairton, Pa. 15025.

In combination with the hydrocarbon resin, there is employed a synthetic hydrocarbon polymer such as an isobutylene-butene copolymer. An example of such copolymer is Poly S 2000, obtainable from S and S Chemical Company, 445 Northern Boulevard, Great Neck, N.Y. 11021 (high molecular weight mono-olefin content 95–100%, the balance being isoparaffins).

The organic solvent for the tackifying solution may be VM&P naphtha, heptane or any other non-polar, conventional organic solvent.

In preparing the tackifying solution, the isobutylene-butene copolymer and hydrocarbon resin are desirably mixed and dissolved separately with a portion of the organic solvent and then are mixed together with more of the solvent to the desired specific gravity.

While a wide variety of ratios of isobutylene-butylene copolymer to hydrocarbon resin may be employed, it has been found that about 10:1–1:10 parts of hydrocarbon resin per 1 part of the copolymer is usable. A ratio of 1 part of hydrocarbon resin to 10 parts of copolymer is preferred.

The resultant tackifying solution desirably has a specific gravity of about 0.770 at 22° C.

Impregnation is effected by immersion of the leather in the tackifying solution for about 1 to 2 minutes and then hanging the leather at room temperature under slow-moving air fans until the leather is dry.

In order to detackify the flesh side of the leather, a formulation was discovered which provides the desired non-tacky surface but yet also provides suitable adhesion to the substrate and the "feel" of leather.

Silicone resins do not readily adhere to leather already possessing a tackified surface. However, the copresence of the nitrocellulose binder mixed with silicone provides satisfactory adhesion of the silicone to the already tackified fibers.

The ratio of silicone resin to nitrocellulose resin can vary widely, e.g. 1:30 to 1:10 but is preferably about 1:17.

The application of the detackifying composition can either be by spraying or by other conventional coating methods, followed by drying to remove the solvent.

The amount of detackifying agent applied can vary widely depending on the amount of detackifying effect desired.

A recommended amount would increase the weight of the leather by 5 to 7%.

The following is an example of one manner in which the invention may be practiced:

EXAMPLE

A. Tackifying procedure

A sheet of calfskin leather was permanently tackified on both sides by impregnation in a VM&P naptha solution containing 1 part by weight Piccolyte S70 hydrocarbon tackifying resin to 10 parts by weight Poly S2000 isobutylene-butene copolymer.

The leather was dried to provide a permanently tackified surface on both sides thereof.

B. Detackifying procedure for N.T.B.

The sheet of the above tackified leather was treated on the flesh side with the following solution:

52% by weight of Hydrholac® SD-270 nitrocellulose lacquer emulsion from Rohm and Hass Company, Philadelphia, Pa. 19105 and 3% by weight Silicone Resin LS-3399. This is a xylene solution of silicone resin from Rohm and Hass Company, Philadelphia, Pa. 19105.

The solvent for the above additives is thinner LS-3082 at 45% by weight. This is blend of n-propylacetate, methylethyl ketone and toluene, also from Rohm and Hass Company.

After the nitrocellulose and silicone additives were dissolved in the solvent, the solution was sprayed on the flesh side of the leather and the resultant leather was dried.

The leather possessed a tackified outer (grain) surface and yet a smooth, fairly natural glove to hand "feel" on the inner (flesh) side.

The leather was cut and sewn together to provide a glove permanently tackified on the outside and comfortably detackified on the inside.

In making the tackified glove, it is preferred that the tackified N.T.B. leather be generally used only on the palm side of the glove, including the palm side of the fingers and at times the whole of the thumb, forefinger, and small finger of the glove. The tackified side of the leather faces out, the N.T.B. being against the palm and fingers of the hand. Other parts of the glove (the back) can be made of completely untackified glove leather or other conventional glove materials.

Modifications of the foregoing which are within the spirit and scope of the invention will be readily apparent to those of ordinary skill in the art.

I claim:

1. A tackified glove having an inner and outer surface and at least a portion of said inner surface detackified, said glove being produced by a process which comprises the steps of:

a. immersing leather in an organic solvent solution containing a hydrocarbon tackifying resin and an isobutylene-butene copolymer in a ratio of hydrocarbon resin to copolymer of 10:1 to 1:10 to impregnate the leather on both sides with said solution, b. evaporating the solvent from said impregnated leather sheet to thereby tackify both sides of said leather, c. detackifying at least a portion of the inner side of said leather by applying thereto an organic solvent solution containing nitrocellulose and a silicone resin in a ratio of silicone resin to nitrocellulose of 1:30 to 1:10, d. evaporating the solvent from the leather of step c. and e. sewing the leather into a glove, wherein the outer side is tackified and the inner side is detackified, but yet retains the feel of leather.

2. The tackified glove according to claim 1 wherein the ratio of said isobutylene-butene copolymer to said hydrocarbon tackifying resin is about to 10:1.

3. A process for treating leather which comprises:

a. immersing said leather into an organic solvent solution containing an isobutylene-butene copolymer and a hydrocarbon tackifying resin in a ratio of hydrocarbon resin to copolymer of 10:1 to 1:10, to impregnate the leather with said solution, b. evaporating the solvent from said impregnated leather to thereby tackify both sides of said leather, c. detackifying at least a portion of the inner side of said leather by applying thereto an organic solvent solution containing nitrocellulose and a silicone resin in a ratio of silicone resin to nitrocellulose of 1:30 to 1:10, and d. evaporating the solvent from the leather of step c.

4. The leather produced by the process of claim 3.

5. A process for producing a glove which has the outer surface thereof tackified and the inner surface thereof detackified which comprises the steps of:

a. immersing leather in a solution containing an isobutylene-butene copolymer and a hydrocarbon tackifying resin, in an organic solvent in a ratio of hydrocarbon resin to copolymer of 10:1 to 1:10, to impregnate the leather with said solution, b. evaporating the solvent from said impregnated leather sheet to thereby tackify both sides of said leather, c. detackifying at least a portion of the inner side of said leather by applying thereto an organic solvent solution containing nitrocellulose and a silicone resin in a ratio of silicone resin to nitrocellulose of 1:30 to 1:10, in an organic solvent, d. evaporating the solvent from the leather of step c. and e. sewing the leather into a glove, wherein the outer side is tackified and the inner side is detackified but yet retains the feel of leather.

6. The tackified glove according to claim 2 wherein the nitrocellulose, silicone and solvent are present at about 52%, 3% and 45% by weight respectively, in said solution.

* * * * *